US005815994A

United States Patent [19]

Knight et al.

[11] Patent Number: 5,815,994

[45] Date of Patent: Oct. 6, 1998

[54] STRENGTHENING OF POLES

[75] Inventors: John Keith Knight, Doncaster; Noel William Murray, Clayton North, both of Australia

[73] Assignee: Powerbeam Pty, Ltd., Duncaster, Australia

[21] Appl. No.: 849,762

[22] PCT Filed: Aug. 28, 1995

[86] PCT No.: PCT/AU95/00547

§ 371 Date: Jun. 12, 1997

§ 102(e) Date: Jun. 12, 1997

[87] PCT Pub. No.: WO96/18788

PCT Pub. Date: Jun. 20, 1996

[30] Foreign Application Priority Data

Dec. 16, 1994 [AU] Australia ..... PN0125

[51] Int. Cl.[6] ..... E02D 27/42

[52] U.S. Cl. ..... 52/170; 52/153; 52/154

[58] Field of Search ..... 52/170, 153, 154

[56] References Cited

U.S. PATENT DOCUMENTS

| | | | |
|---|---|---|---|
| 1,817,342 | 8/1931 | Beecher | 52/170 |
| 4,516,365 | 5/1985 | Chapman | 52/170 |
| 4,697,396 | 10/1987 | Knight | 52/170 |
| 5,345,732 | 9/1994 | Knight et al. | 52/170 |

*Primary Examiner*—Creighton Smith
*Assistant Examiner*—W. Glenn Edwards
*Attorney, Agent, or Firm*—Sixbey, Friedman Leedom & Ferguson; Frank P. Presta; Joseph S. Presta

[57] ABSTRACT

A bridging beam for bridging a weakened area of a pole to reinstate the pole. The beam includes a sleeve for abutting the external surface of the pole on an inner surface of the sleeve and an external brace extending outwardly from an outer surface of the sleeve. The brace is constructed to brace the sleeve in radial and tangential directions relative to the sleeve. The brace is formed as an elongate tubular box section.

23 Claims, 9 Drawing Sheets

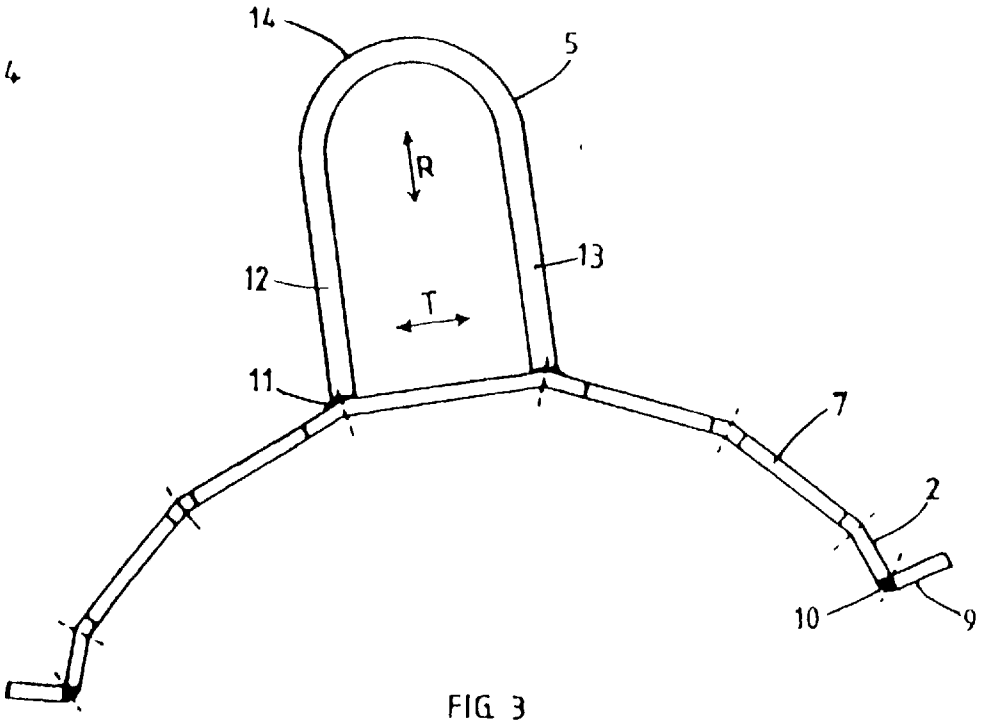
FIG. 3
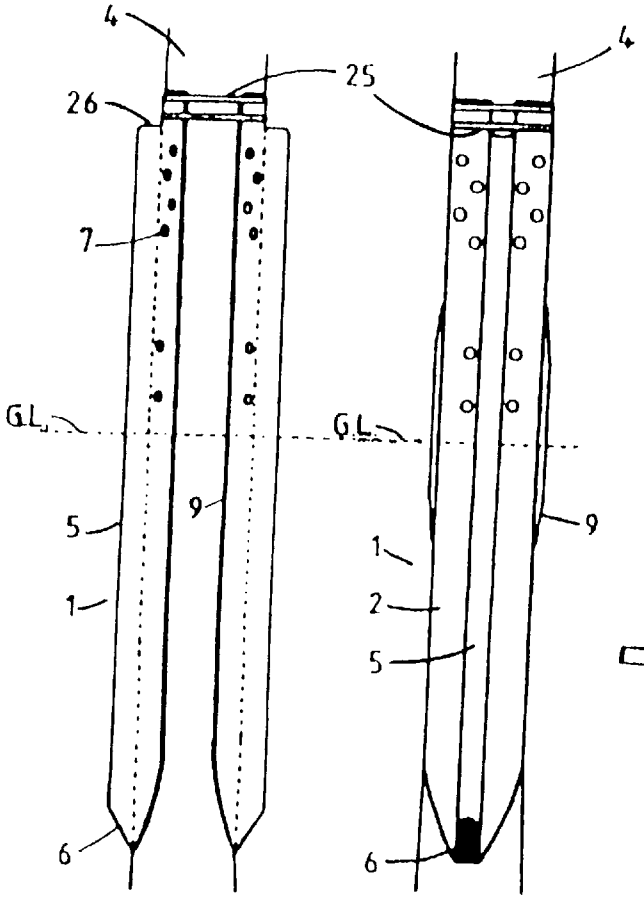
FIG. 4
FIG. 5

46
44
46
40
41
54

STRENGTHENING OF POLES

FIELD OF THE INVENTION

The present invention relates to the strengthening of poles and, more particularly has application to the reinstatement of poles particularly damaged poles.

BACKGROUND OF THE INVENTION

The present invention can be applied to poles used by utilities for carrying telecommunications lines, electric power lines and the like. It is to be appreciated however that the invention has application to other forms of poles including pylons, stumps, flagpoles, mooring posts and the like.

Poles of the type to which this invention has particular application are typically wooden poles and it is well known that a wooden pole is most vulnerable to rot, decay or similar degradation at about ground level including the area from slightly above to slightly below the ground line of a standing pole. This is the area in which rot generally begins and as the decay spreads the pole is weakened. If a utility pole should fail, there may be serious disruption to telecommunications and/or power supply. Further, the sudden failure of a pole is a risk which linesman working on such poles face regularly. In addition to the risks of a faulty pole falling and bringing down not only the lines but also linesmen with it, there are risks to passers-by and neighbouring buildings or other structures. Similar dangers and inconvenience may result from the failure of poles used in other applications.

The reinstatement of damaged poles is accordingly an important consideration. However it can be difficult to properly identify damage to a pole. Accordingly it may sometimes be necessary or advisable to provide added strength to a sound pole. The terms reinstate and reinstatement are accordingly used herein to refer to the addition of strength to a pole irrespective of whether the pole has been previously damaged and/or weakened in any way.

When a pole carrying transmission lines fails, the pole is generally supported by the overhead lines in the longitudinal direction of the lines. Accordingly, it is more typical for a utility pole which fails to fall sideways, ie. transversely of the overhead transmission lines.

There has been a number of proposals for providing support members for adding strength to a pole. However, the previously known members suffer the disadvantage that the added strength is typically provided substantially normally to the support member and limited support is provided tangentially thereto. Accordingly, in order to provide sufficient support to restrain a failed pole from falling transversely of an overhead transmission line, it is necessary for the prior art support members to be placed beside the pole rather than between neighbouring poles.

In urban areas, underground services which may include gas, water, power, stormwater and other services are typically located in an easement which runs substantially beneath and parallel to the overhead transmission lines. Accordingly other services may run beside transmission poles but generally are not placed between neighbouring poles. Therefore, there is an added risk in the prior art arrangements that installation of such prior art support members beside a pole rather than between neighbouring poles may cause disruption to underground services.

Moreover, prevailing winds can play a significant role in the direction of fall of a failed pole and it is not always possible to predict accurately the direction from which the fatal wind gust will appear and to orient a support member accordingly. Furthermore in the event of a single conductor failing a power pole can be subjected to a twisting moment about its longitudinal axis.

Accordingly, there exists a need for the capacity to reinstate poles in a manner which provides improved support in both the normal and tangential directions relative to the support member, ie. longitudinally and transversely with respect to the lines carried by a transmission pole as well as resistance to twisting about the longitudinal axis of the pole.

SUMMARY OF THE INVENTION

The present invention accordingly provides in one preferred embodiment a bridging beam for bridging a weakened area of a pole to reinstate the pole including a sleeve for abutting the external surface of the pole on an inner surface of said sleeve and an external brace extending outwardly from an outer surface of said sleeve portion, said brace being constructed to brace the sleeve in radial and tangential directions relative to this sleeve. Resistance to twisting about the longitudinal axis may also be provided by the brace. Connection means may be provided for connecting the beam to a pole being resinstate.

A bridging beam provided by the present invention is preferably suitable for being driven into the ground in a substantially vertical orientation immediately beside the pole to be reinstated. The bridging beam may be formed from steel or other material of suitable strength and other properties. Preferably all components of a beam according to the present invention are adapted to be galvanised or otherwise treated against the adverse effects of weathering and soil immersion.

A beam according to the present invention may include a sledge end to facilitate driving the beam into the ground immediately adjacent the pole being reinstated. The sledge end may include a curved or otherwise upturned portion immediately adjacent the lower point of the beam in use.

Most preferably, a beam according to the present invention is of substantially constant cross section throughout the major portion of its length. In particular, it is preferred that a bridging beam according to the present invention does not taper for a significant portion of its length as we have found that a greater surface area of sleeve portion in contact with the pole provides improved friction against the pole and the surrounding soil and hence improved reinstatement capabilities.

A sleeve of a bridging beam according to the present invention is preferably formed from a single piece of material. The sleeve may be substantially arcuate in cross section. However, sleeves of other cross sectional shapes including substantially channel shaped, angled and polygonal shaped sections among others are also envisaged within the scope of the present invention. Most preferably the shape of the inner surface of the sleeve is such as to be complementary to the shape of the circumference of the pole being reinstated.

A sleeve according to the present invention is preferably apertured whereby to enable connection means to pass through the sleeve and into the pole being reinstated as described in greater detail below.

A sleeve according to the present invention may be curved or otherwise shaped at the lower most extremity in use whereby to facilitate driving the beam into the soil immediately surrounding the pole undergoing reinstatement. A cambered end portion or sledge end is particularly preferred.

A sleeve according to the present invention preferably spans less than 50% of the circumference of the pole.

Preferably the sleeve spans more than 10% of the circumference of the pole and most preferably between about 20% and about 40% of the circumference of the pole undergoing reinstatement. It will be appreciated therefore that the shape and size of a sleeve provided in accordance with the present invention may vary substantially depending upon the shape and size of the pole undergoing reinstatement. Irrespective of shape and size the sleeve preferably comprises a unitary member which carries the other components provided in accordance with the present invention.

The outer marginal edges of a sleeve according to the present invention are preferably substantially vertical in use. According to one preferred embodiment of the invention a gusset is provided along at least a portion of either or both outer marginal edges of the sleeve. The gusset may be in the form of an extension of the outer edge which preferably projects outwardly from the pole. Most preferably the gusset is formed integrally with the sleeve.

A gusset according to the present invention may extend substantially along the length of a sleeve or, more preferably is of a sufficient length of bridge the decayed area of a pole undergoing reinstatement. We have found that it is generally sufficient for a gusset to extend over at least 10% of the vertical extent of the sleeve, preferably between 10% and 40% and most preferably between 10 and 25% of the overall length of a sleeve according to the present invention.

A gusset provided according to the present invention may extend substantially normally the plane of the sleeve at the join between the gusset and the sleeve or may extend outwardly at a more shallow angle from the outer marginal edge of the sleeve.

A sleeve according to the present invention also carries a brace extending outwardly from the outer surface of the sleeve. The brace may be in the form of an extended channel mounted outwardly of the sleeve. The brace and sleeve may be formed integrally with one another, however, for ease of manufacture it is presently preferred that the brace and sleeve be initially formed as two separate members and that the brace be subsequently permanently mounted on the sleeve such as be welding or other suitable mounting means. The brace is intended to provide additional stability to the sleeve and hence to the reinstated pole. The construction and arrangement is preferably such that the brace imparts added stability to the sleeve in a direction tangentially to the sleeve in the area of the brace, ie. transversely of the brace as well as normally to the sleeve in the area of the brace, ie. radially of the pole.

The brace is typically an elongated member. A brace according to the present invention is preferably formed as a unitary member but may include a number of brace members joined to one another. A brace according to the present invention is preferably channel shaped and may be in the form of a box channel or a U-shaped channel although other forms of channel shape are also envisaged within the present invention.

The brace may form an elongate tubular member when joined to the sleeve. The outline of the elongate tubular member need not be substantially circular. Other cross-sectional shapes including generally semioval, semicircular, box, triangular or polygonal cross sections or a combination of such cross sections are all invisaged within the scope of the present invention.

A brace according to the present invention preferably includes a pair of arms or other elements whereby the brace may be mounted on the other surface of the sleeve at two spaces locations. Between these attachment locations the sleeve portion acts as a spreader for the brace thereby acting to maintain the integrity of the brace under load. When the brace is a channel shaped member the spreader and the brace effectively form a box section providing additional strength to the bridging beam provided in accordance with the present invention in both the tangential and normal directions. The box section can also provide strength to resist twisting about the longitudinal axis of the pole.

In accordance with the present invention the bridging beam is preferably connected to the pole by connecting means. The connecting means may be in the form of a threaded connector extending through the pole. The threaded connector may be in the form of a bolt having a head at one end and a nut or similar fastener at the other. Preferably the fastener can be progressively tightened to fasten the connector in position.

The connector may extend directly between two sleeve portions according to the present invention.

In an alternative arrangement it is only necessary to use a single sleeve portion according to the invention. In this arrangement a backing plate is preferably provided to facilitate the mounting of one end of the connector whereby to spread the load exerted by the connector over the outer surface of the pole.

While it is convenient to hereinafter describe the connection means with reference to a connector extending between a sleeve portion of one bridging beam according to the present invention and a backing plate, it is to be appreciated that the backing plate may in fact be replaced by a second sleeve portion to perform the same function in relation to the location of the connection means.

A backing plate is preferably an enlarged plate which is apertured to receive an end of a connector according to the present invention. The size and shape of a backing plate may be varied as known in the art with a view to spreading the load exerted by the connector over a greater surface area to reduce the prospect of local damage to the wood fibers of the pole and also to provide additional strength.

A connector according to the present invention preferably extends substantially across the centre of the pole and may accordingly form a diameter for a circular pole. It may be appreciated however that in practice the question of whether a connector passes precisely through the centre of a pole is not altogether important and a connector may accordingly be installed to extend across a pole slightly to one side of the centre point without departing from the spirit or ambit of the invention. Similarly, in the case of some irregular poles, it may be not even be possible to locate a centre.

When a hole is drilled across a pole to receive a connector according to the present invention, this necessarily removes a portion of the timber of the pole which may not only further weaken the pole but may result in new sites for moisture and other penetrations of the wood fibres which may provide new sites for decay to originate. This is particularly so closer to the surface of the pole.

We have now found that it is preferable for the outer extremities of a connector according to the present invention to be countersunk into the pole. We have found such countersinking to be most preferable when a connector end is mounted on a sleeve portion but of lesser importance where a connector end is mounted on a backing plate. The countersink hole is preferably substantially concentric with the central bore extending through the pole for receiving the connector. The countersink hole is preferably substantially frusto-conical in shape. The broader base of a coned countersink hole preferably substantially abuts the outer surface of the pole.

Most preferably the shape and dimension of the countersink hole provided in a pole is complementary to the shape and dimension of an end cap which may be provided to receive and mount either or both ends of a connector. An end cap may be inserted into the countersink hole. An end cap according to the present invention preferably contains a central bore which in use is aligned substantially with the central bore extending through the pole. An end cap is preferably substantially frusto-conical in shape.

The end cap is preferably shaped to provide a seat for the head of a connector and the nut or fastener of a connector according to the present invention. Most preferably an end cap according to the present invention has an outwardly extending lip which may be arranged to extend over the marginal edges surrounding an aperture in the sleeve portion or a backing plate. A shank portion may depend from the outwardly extending lip of a cap whereby to pass through the sleeve portion. The shank portion may merge with the frusto-conical end portion.

We have found that this frusto-conical end portion of a cap according to the present invention is of particular advantage in that a protective material such as a boron/fluoride based preservative cream may be inserted into the countersink hole prior to assembly of the connection means according to the present invention, in which case the lightening of the connection means will result in the preservative cream being urged into the wood fibres of the pole. In this way the newly exposed edges of the countersink hole may be protected against the effect of weather and the likelihood of acting as fresh sites for decay of the pole. The cream or other preservative provided may also act as a moisture barrier to resist moisture permeating into the interior of the pole whereby to act as a further form of degradation within the central bore.

In one particularly preferred arrangement an end cap according to the present invention may be threaded so that a separate nut is not required and the end cap may itself act as a fastener. In this arrangement the external bore of the end cap may be hexagonal or otherwise shaped to receive a fastening tool of complementary shape whereby to tighten the end cap on the threaded portion of the connector. Such a hexagonal or other shaped bore may also be useful for retaining the head of a connector in accordance with the present invention to facilitate tightening of the connection means as will be appreciated by those skilled in the art.

A brace in accordance with the present invention preferably does not extend to the upper extremity of the sleeve portion. In this way a portion at the upper end (in use) of the sleeve portion may be free of brace and this unbraced sleeve portion may be suitable for receiving strapping which may pass around the pole being reinstated. Where a pair of bridging beams in installed by strapping preferably binds the unbraced sleeve portion of each beam. Where only one beam is employed to reinstate a pole a backing plate may be provided against the outer surface of the pole to receive the strapping and spread the load exerted thereby over a broader area. Such a backing plate is optionally apertured to also received a portion of the connecting means connecting the beam to the pole.

The strapping is preferably stainless steel or other material of suitable strength. Various means of securing heavy duty strapping around the unbraced sleeve portion of one or more bridging beams according to the present invention are currently known in the art. The strapping of the unbraced sleeve portions may provide a form of socket at the upper end of a bridging beam according to the present invention. The socket may further strengthen the pole at the upper end.

The upper end of a brace according to the present invention may act as a driving surface for a hammer or other arrangement to drive the beam into the surface immediately surrounding the pole to be reinstated. Accordingly the upper surface of a brace according to the present invention is preferably substantially horizontal in the intended orientation of use. Preferably an insert or dolly which is constructed with a head to toe hammer blows is inserted into the end of the tubular member forming the upper end of the brace.

The components used in accordance with the present invention including the beam and the connection means are preferably formed of materials which not only have sufficient strength to perform the task required but are also unlikely to be corroded or otherwise degraded rapidly in the prevailing weather conditions. The materials should also preferably not be such as to establish any form of adverse reaction with the sound timber of the pole. We have found that a steel beam, preferably galvanised, and connectors formed of steel or other non-corroding metallic components are particularly suitable for use in accordance with the present invention.

BRIEF DESCRIPTION OF THE DRAWINGS

To further assist in the understanding of the present invention, particularly preferred embodiments of the invention will now be described in relation to the accompanying drawings.

FIG. 3 is a cross sectional plan view of a bridging beam according to another preferred embodiment of the present invention;

FIG. 4 is a side view of a pole reinstated with the bridging beam of FIG. 3;

FIG. 5 is a side view at 90° to that of FIG. 4;

DETAILED DESCRIPTION OF THE PREFERRED EMBODIMENTS

Figure 1:
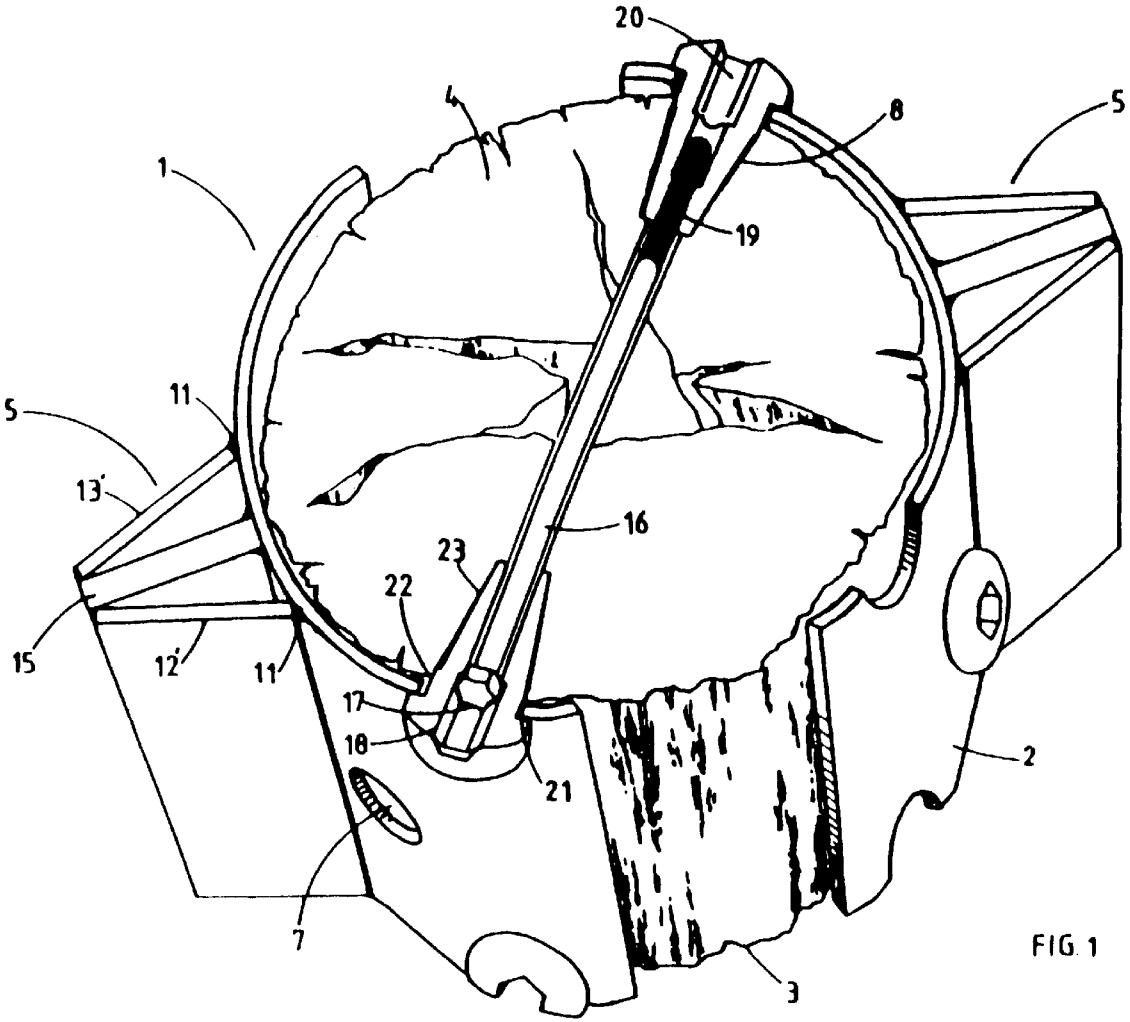
FIG. 1 is a cut away cross sectional perspective view of a reinstated pole according to one preferred embodiment of the present invention.

Referring to the drawings, a bridging beam 1 according to the present invention comprises a sleeve portion 2 for abutting the external surface 3 of a pole 4. As clearly seen in FIGS. 1 and 2, pole 4 has been weakened by decay in the central portion.

Beam 1 includes an external brace 5 to provide additional stability to sleeve 2 and hence to reinstated pole 4.

Brace 5 is referred to herein as an external brace member since it is mounted on the outside of sleeve 2 while the inside of sleeve 2 abuts the external surface 3 of pole 4.

As best seen in FIGS. 4 and 5, a bridging beam 1 is of substantially constant cross section throughout the major portion of tis length. Bridging beam 1 does not taper for a significant portion of its length but includes a cambered end portion 6 also referred to as sledge end 6 at the lower most extremity of beam 1 which is shaped to facilitate driving beam 1 into the soil immediately surrounding pole 4.

Figure 6:
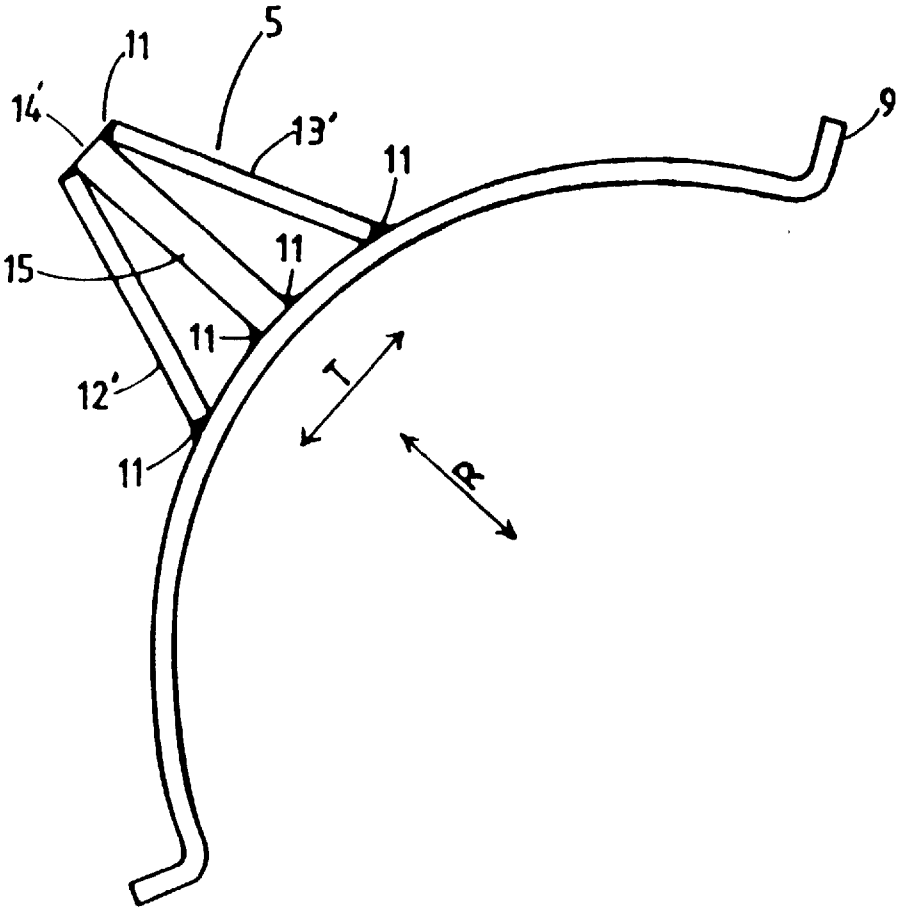
FIG. 6 is an end view of a bridging beam according to another preferred embodiment of the present invention.

As best seen in FIGS. 3 and 6, sleeve 2 is formed, in the preferred arrangements illustrated, from a single piece of material. Sleeve 2 is substantially arcuate in cross section in the embodiments shown in FIGS. 1 and 6, however in the embodiment shown in FIGS. 2 and 3, sleeve 2 comprises a polygonal shaped section. Both the smooth curve and the polygonal shaped curve of sleeves 2 are complementary to the shape of the circumference of the poles being reinstated and in cases where poles have a more clearly defined and reproducible outer shape, the shape of sleeve 2 can be adjusted to be complementary thereto.

As clearly seen in FIGS. 4 and 5, sleeve 2 includes apertures 7 through which at least a portion of connection means 8 passes.

As clearly seen in FIGS. 4 and 5, the outer marginal edges of sleeve 2 are substantially vertical in use. In the embodiments illustrated in FIGS. 4 and 5, the representative ground line for an installed pole is indicated by dotted line G-L. As clearly illustrated in FIGS. 4 and 5, a gusset 9 is provided along a portion of both outer marginal edges of sleeve 2. As clearly seen from FIGS. 3 and 6, gusset 9 is in the form of an extension of the outer edge of sleeve 2 which projects outwardly from the pole. In the embodiment illustrated in FIG. 6, the gusset is formed integrally with the sleeve although a separate element attached to sleeve 2 such as by welding is used in the embodiment of FIG. 3.

As best seen in FIGS. 4 and 5, gusset 9 extends longitudinally of the outer marginal edges of sleeve 3 for a sufficient length to bridge the decayed area of pole 4.

In the embodiment illustrated in FIG. 3, gusset 9 extends substantially normally to the plane of sleeve 2 at the join 10 between gusset 9 and sleeve 2. In the embodiment illustrated in FIG. 6, gusset 9 is formed integrally with sleeve 2. Although gusset 9 as shown in FIGS. 3 and 6 is in both cases arranged substantially normally to sleeve 2, other angles are also envisaged within the scope of the present invention.

The embodiments shown in FIGS. 3 and 6 show two different forms of external brace 5 in accordance with the present invention. Other forms of brace 5 are also envisaged within the scope of the invention.

In the embodiment shown in FIG. 3, brace 5 is in the form of an external channel positioned outwardly of sleeve 2 and permanently mounted thereon by welds 11 although other forms of attachment are also envisaged within the scope of the present invention.

The construction and arrangement of brace 5 in each case imparts an added stability to sleeve 2 in a direction tangentially to sleeve 2 as indicated by the double headed arrow T as well as normally to the sleeve and hence radially of the pole as indicated by the double headed arrow R. By imparting stability to the sleeve in both directions T and R, the brace 5 effectively provides stability in other directions also.

In the embodiment shown in FIG. 3, channel shaped brace 5 is in the form of a U-shaped channel having a pair of arms 12 and 13 connected by domed web portion 14. The brace 5 is mounted on the outer surface of sleeve 2 at the speed locations indicated by welds 11. Although sleeve 2 is in a single unitary member, it can be appreciated that the portion of sleeve 2 which extends between welds 11 acts as a spreader for brace 5 thereby acting to maintain the integrity of brace 5 under load. In the embodiment shown in FIG. 3, the brace 5 together with the spreader portion of sleeve 2 effectively form a box section with the sleeve 2 providing additional strength to the beam 1.

In the alternative arrangement shown in FIG. 6, arms 12' and 13' are welded together at apex 14' of brace 5. In that arrangement, there is an additional strengthening member 15 which extends radially of the pole between the outer surface of sleeve 2 and apex 14'. When strengthening member 15 is employed this provides additional strength to beam 1.

Figure 2:
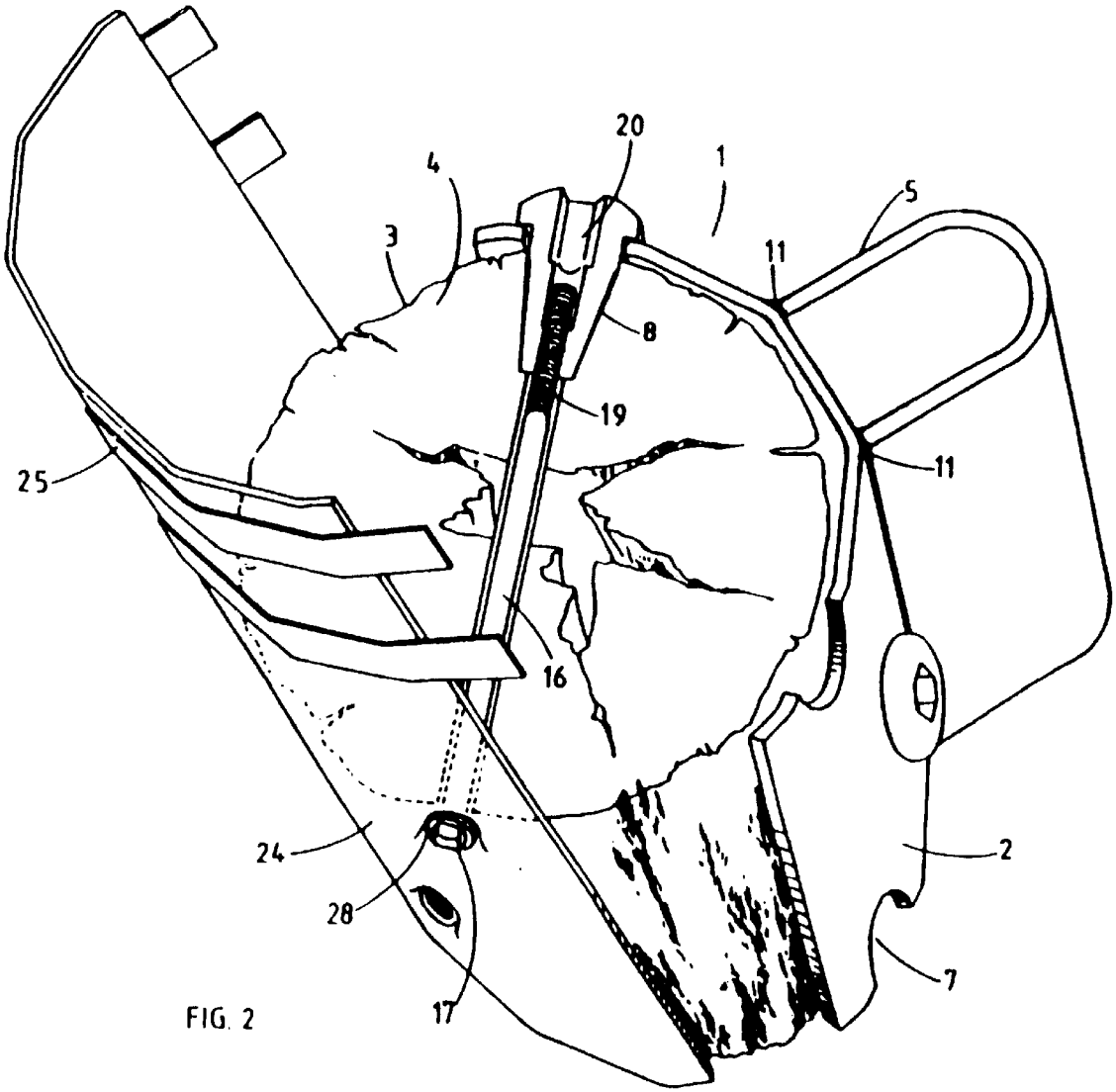
FIG. 2 is a cut away cross sectional perspective view of a reinstated pole according to another preferred embodiment of the present invention.

As clearly seen in FIGS. 1 and 2 bridging beam 1 is connected to the pole 4 by connecting means 8. Connecting means 8 is in the form of threaded connector 16 which extends through pole 4. Threaded connector 16 is in the form of a bolt having a head 17 at one end. In the arrangement of FIG. 1 head 17 is captured in frusto-conical end cap 18 whereas the other threaded end 19 of connector 16 threadedly engages end cap 20.

As clearly seen in FIGS. 1 and 2, connector 16 extends substantially across the centre of pole 4. End caps 18 and 20 each contain a central bore which in use is aligned substantially with the central bore extending through the pole to receive threaded connector 16. End caps 18 and 20 each have an outwardly extending lip 21 arranged to extend over the marginal edges surrounding an aperture 7 in sleeve portion 2. A shank portion 22 depends from outwardly extending lip 21 whereby to pass through the aperture in sleeve 2. Shank portion 22 merges with frusto-conical end portion 23 which nestles into a corresponding frusto-conical countersink hole in pole 4.

As clearly seen in the drawings end caps 18, 20 and the other end caps illustrated include an hexagonal bore useful for receiving a complementary shaped tool to facilitate tightening of the connection means by rotation of the end cap.

Figure 9:
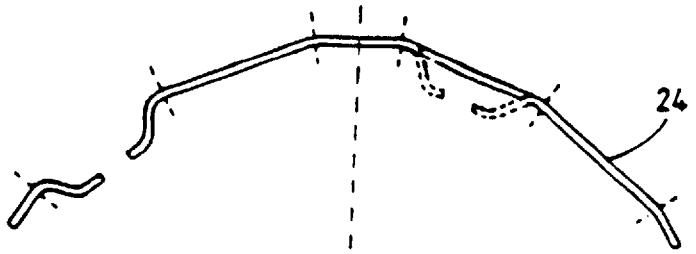
FIG. 9 is a cross sectional end view of the plate of FIG. 8.
Figure 8:
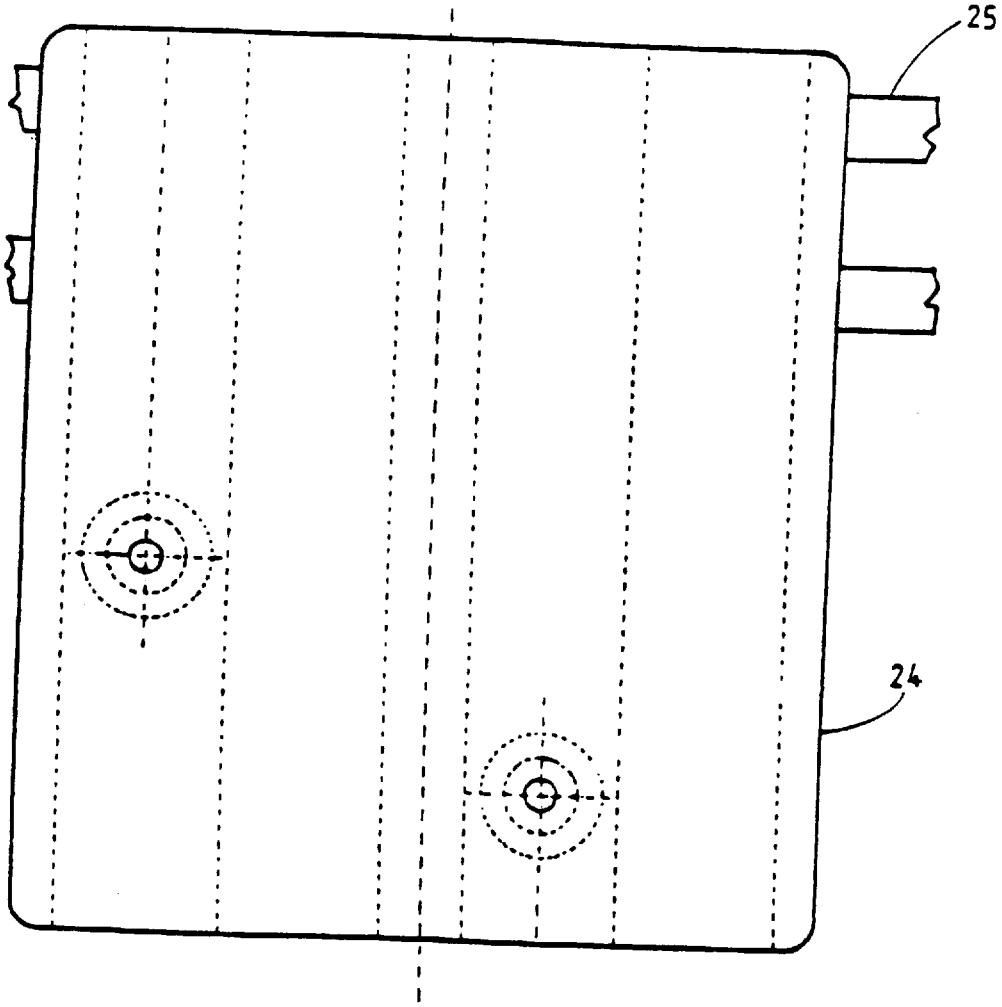
FIG. 8 is a side view of a backing plate according to one preferred embodiment of the invention which may be used in connection with any of the embodiments of the reinstated poles or bridging beams disclosed herein.
Figure 11:
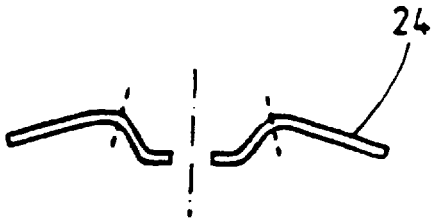
FIG. 11 is a cross sectional end view of the plate of FIG. 10.
Figure 10:
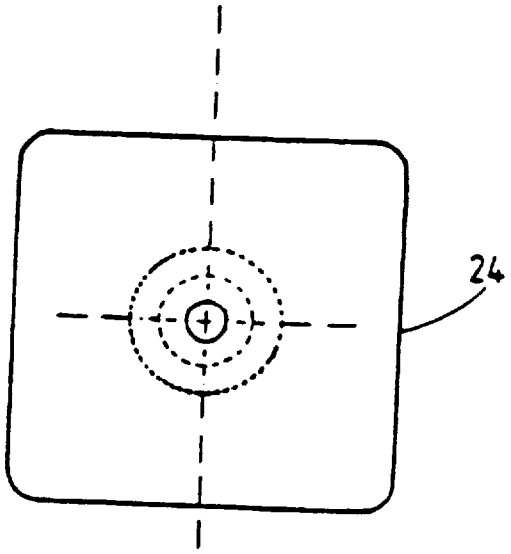
FIG. 10 is a side view of an alternative preferred form of backing plate in accordance with the present invention.

The two alternative forms of backing plate 24 shown in FIGS. 8 through 11 vary in size but both are shaped to substantially conform to the external surface 3 of pole 4. The backing plate shown in FIGS. 8 and 9 is significantly larger than that shown in FIGS. 10 and 11 as an illustration of the differing forms of backing plate which may be utilised in accordance with the present invention. The size and shape of backing plate 24 may be varied as known in the art with a view to spreading the load exerted by connecting means 8 over a greater area of external surface 3.

As best seen in FIG. 4, brace member 5 does not extend to the upper extremity of sleeve portion 2. This enables a portion at the upper end of beam 1 to be free of brace 5 and this unbraced sleeve portion is suitable for receiving strapping 25 which passes around pole 4.

In the arrangement shown in FIG. 2, where only one bridging beam 1 is required to reinstate the pole, strapping 25 binds the unbraced sleeve portion at the upper end of brace 5 (not shown) and backing plate 24 receives the strapping 25 and the other side of pole 4, thereby spreading the load exerted by strapping 25 over a broader area of external surface 3. In the embodiment illustrated in FIG. 2, backing plate 24 is also apertured to receive connecting means 8. In this arrangement the head 17 of threaded connector 16 is directly mounted on backing plate 24 via washer 28. In this arrangement the use of an end cap and countersink hole are avoided. The other end of connector 16 is mounted on sleeve 2 via threaded arrangement in end cap 18.

As clearly seen in FIG. 4, the upper end of brace 5 is substantially horizontal in use and may act as a driving surface 26 to beam 1 into the ground immediately adjacent pole 4.

Figure 7:
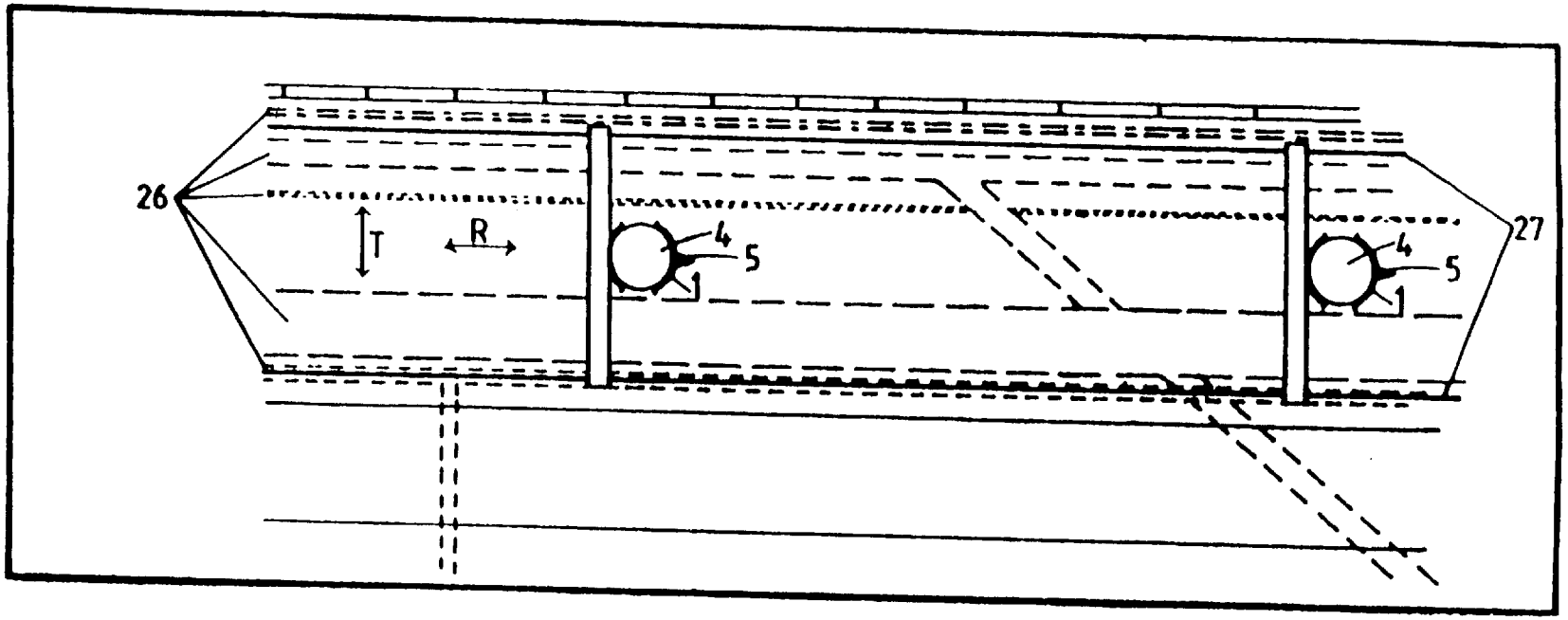
FIG. 7 is a plan view of a transmission arrangement according to one preferred embodiment of the present invention which may be used in connection with any of the embodiments disclosed herein.

As shown in FIG. 7, underground services 26 may be located in an easement which runs substantially beneath and parallel to overhead transmission line 27. Such services generally run beside poles 4 and sometimes cross the easement but do not generally do so in close proximity to neighbouring poles.

If either of the poles 4 shown in FIG. 7 failed, one would expect that the transmission lines 27 would prevent the pole from falling in a direction longitudinally of transmission lines 26 which is in the direction indicated by the double headed arrow R. However, if either pole 4 should fail, it would be more typical for the pole to fall sideways, ie. transversely of the transmission lines 27 in the general direction indicated by double headed arrow T. It is to be noted from FIG. 7 that the directions T and R correspond to those in FIGS. 3 and 6. The beam provided by the present invention accordingly can be located as illustrated in FIG. 7 between neighbouring poles 4 while providing improved support in both the normal and tangential directions indicated by double headed arrows T and R without being in danger of contacting the other surfaces by being installed within the casement which would be the case if beams 1 were installed beside poles 4 at an angle of 90 to the location shown in FIG. 7. The beams 1 provided in accordance with the present invention and the method disclosed herein for reinstated poles 4 accordingly provides a significant advance over the previously known support members.

Figure 12:
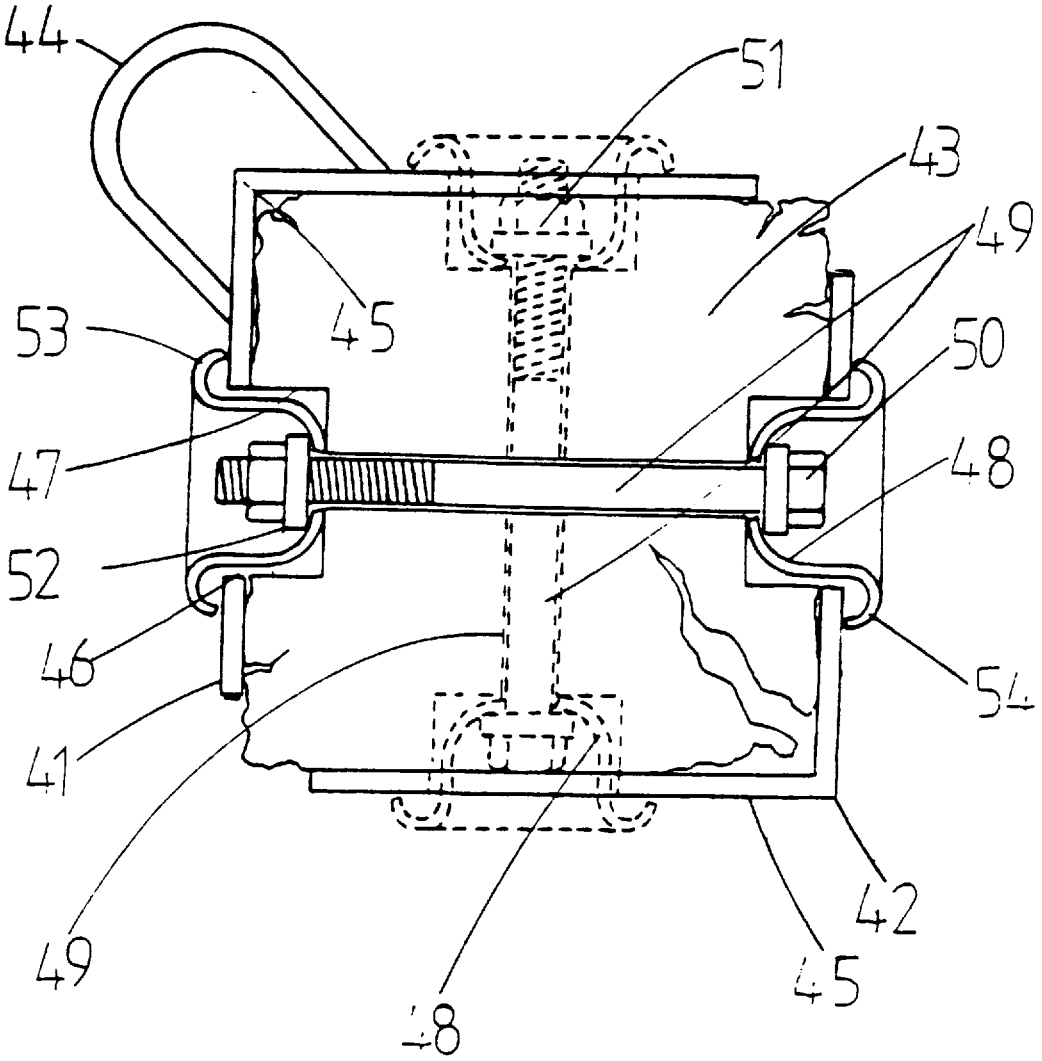
FIG. 12 is a cross sectional end view of a reinstated square pole according to an alternative preferred embodiment of the invention.

In the embodiment shown in FIG. 12, a bridging beam 40 which includes two elongate flat members 41 joined via the right angled join 42 is used to reinstate a pole of square or rectangular cross section 43. As in the previous embodiments, a brace 44 is mounted on the outside of the bridging beam and spans the join 42 between the two elongate flat members forming the sleeve of the bridging beam.

The opposite side of the pole is provided with a backing plate 45 which performs in similar fashion to the backing plates illustrated in the preceding embodiments. Both the bridging beam and the backing plate are provided with a plurality of openings 46 which are used to provide access for the connection which attach the backing plate and the bridging beam to the pole in the manner illustrated.

A number of recesses 47 have been drilled in the pole to accommodate the plugs 48 which act in concert with the connection means to secure the backing plate and the bridging beam to the pole. The backing plate and bridging beam are joined by connection means 49 extending through the pole. The connection means may comprise a bolt 50, nut 51 and washer arrangement 52. These extend through the plugs and the pole to join them and hold them securely in the manner illustrated. It is preferred that the bolts be located so that they generally bisect the square or rectangular cross section of the pole being reinstated. Preferably, successive bolts are at 90° to each other.

The plugs may be formed with a circular shaped flange 53 which is adapted to push up against the outer face of the bridging beam and backing plate when the nut and bolt arrangement is tightened, thereby firmly securing the bridging beam and backing plate to the pole. The shaped flange 53 may have a generally "C" shaped profile. The outer edge of the flange may press against the flat members.

The brace 44 may be formed with a shoe or slipper 54 shaped to force the beam close to the pole when it is pushed in next to the pole as it is being reinstated.

Figures 13, 14:
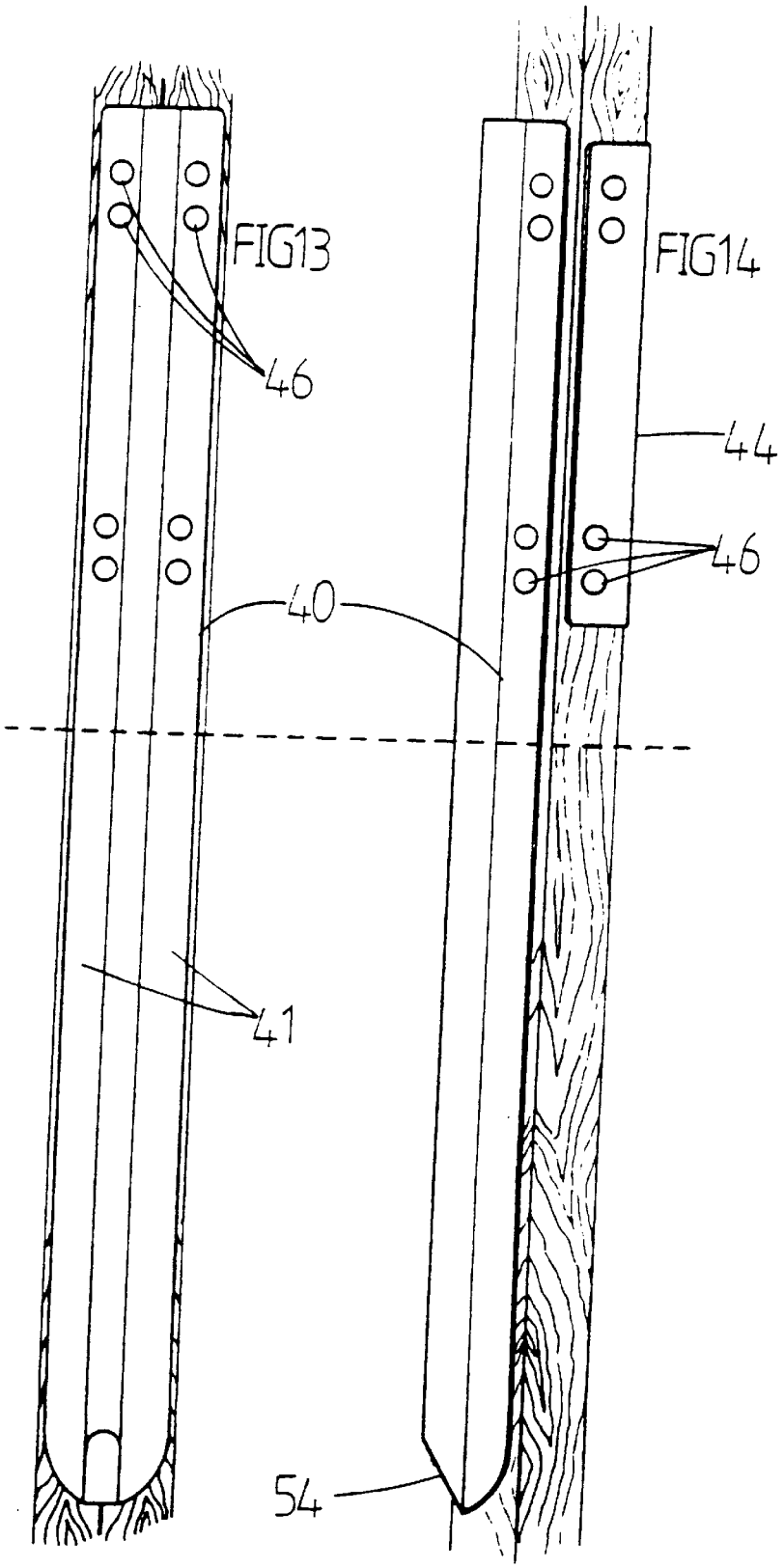
FIG. 13 is a side view of the reinstated pole of FIG. 12.
FIG. 14 is a side view at 90° to that of FIG. 13.

As for the other embodiments, whilst FIGS. 12 to 14 illustrate a bridging beam in association with a backing plate, it is also possible to replace the backing plate with a second bridging beam of similar design to the first. Such constructions may be favoured when the degree of additional strengthening required for the pole is relatively high.

While it has been convenient to describe the invention herein in relation to particular preferred embodiments, it is to be appreciated that other constructions and arrangements are also considered as falling within the scope of the invention. Various modifications, alternations, variations and/or additions to the constructions and arrangements described herein are also considered as falling within the ambit and scope of the present invention.

We claim:

1. A bridging beam for bridging a weakened area of a pole to reinstate the pole said beam including a sleeve for abutting the external surface of the pole on an inner surface of said sleeve and an external brace extending outwardly from an outer surface of said sleeve portion, said brace being constructed to brace the sleeve in radial and tangential directions relative to the sleeve, said brace being formed as an elongate tubular box section.

2. A bridging beam according to claim 1 wherein the brace is mounted on the outer surface of the sleeve at two spaced locations.

3. A bridging beam according to claim 2 wherein the sleeve portion between the two spaced locations acts as a spreader for the brace whereby the brace forms a tubular member with the sleeve.

4. A bridging beam according to claim 3 wherein the outline of said tubular member is selected from one of the group comprising generally semioval, semicircular, box, triangular or polygonal or a combination thereof.

5. A bridging beam according to claim 3 wherein the tubular member includes an elongate strengthening member extending between the brace and the sleeve.

6. A bridging beam according to claim 3 wherein a single elongate brace is mounted on the sleeve said single elongate brace including mounting elements adapted to facilitate mounting of said elongate brace at two spaced locations on the sleeve.

7. A bridging beam according to claim 6 wherein said mounting elements comprise a pair of integral arms extending lengthwise along both sides of the brace.

8. A bridging beam according to claim 1 wherein said sleeve has an upper end and a lower end, said brace extending lengthwise along said sleeve and terminating at one end at a position such that it leaves the upper end of said sleeve free of said brace and said one end of said brace provides a driving surface for facilitating driving of the bridging beam into the ground surrounding the pole to be reinstated.

9. A bridging beam according to claim 1 wherein said sleeve is formed from a single piece of material, the shape of said sleeve being substantially complementary to the shape of the circumference of the pole being reinstated and spanning more than 10% of the circumference of said pole, said sleeve including one or more gussets extending at an angle to and lengthwise along the sleeve.

10. A bridging beam according to claim 9 provided with two gussets extending at an angle to and lengthwise along both sides of said sleeve over at least 10% of the length of said sleeve, said gussets being integral with or welded to said sleeve.

11. A bridging beam according to claim 4 wherein said sleeve has an upper end and a lower end, said brace extending lengthwise along said sleeve and terminating at one end at a position such that it leaves the upper end of the sleeve free of said brace and said one end of said brace provides a driving surface for facilitating driving of the bridging beam into the ground surrounding the pole to be instated.

12. A bridging beam according to claim 1 wherein the brace is constructed to brace the sleeve in such a manner that the sleeve provides resistance to twisting of the pole about the longitudinal axis of the pole.

13. A bridging beam according to claim 1 wherein the sleeve includes a pair of elongate flat members with a right angle lengthwise join therebetween and the brace is joined to each flat member and spans the right angle join.

14. A bridging beam according to claim 13 wherein the flat members integrally form part of a single sheet of metal or are welded together at the right angle join.

15. A method of reinstating a pole including driving a bridging beam according to claim 1 into ground surrounding said pole and securing said bridging beam to said pole.

16. A method according to claim 15 wherein connector means extending from said bridging beam to backing means located on the opposite side of said pole are provided to secure said bridging beam to said pole.

17. A method according to claim 16 wherein said connector means include threaded connectors extending through the pole and said backing means comprise a backing plate or a second bridging beam substantially the same as said first bridging beam.

18. A method according to claim 17 wherein said pole is provided with countersunk holes for receiving end caps which are mounted in mounting holes provided in said first bridging beam and said backing means, said end caps extending into said countersunk holes, and opposed pairs of end caps mounted in said bridging beam and said backing means are joined by said threaded connectors to secure said bridging beam to said pole.

19. A method according to claim 18 wherein said end caps are substantially frusto-conical in shape and have a central bore for receiving said threaded connectors and said threaded connectors each comprise a bolt having a head at one end and a threaded shaft at the other.

20. A method according to claim 19 wherein a preservative cream is inserted in to the countersunk holes prior to insertion of said end caps thereinto.

21. A method according to claim 16, wherein said brace has an upper end and lower end, and said brace extends lengthwise along said sleeve terminating at one end at a position such that it leaves said upper end of said sleeve free of said brace to provide a driving surface, driving said bridging beam into the ground surrounding said pole via said driving surface, securing said bridging beam to said pole by strapping passing around said upper end of said bridging beam and said pole and securing connector means extending through said pole to said bridging beam and to backing means provided on the opposite side of said pole.

22. A pole and wire assembly including a plurality of in line poles arranged to support one or more wires extending therebetween, wherein at least one of said poles has been reinstated in accordance with the method of claim 15 and the brace of the bridging beam used to reinstate the pole extends into the region enclosed between straight parallel lines tangentially touching opposite sides of adjacent poles.

23. A pole and wire assembly including a plurality of in line poles arranged to support one or more wires extending therebetween, wherein at least one of said poles has been reinstated in accordance with the method of claim 21 and the brace of the bridging beam used to reinstate the pole extends into the region enclosed between straight parallel lines tangentially touching opposite sides of adjacent poles.

* * * * *